US005249338A

United States Patent [19]

Aoki

[11] Patent Number: 5,249,338

[45] Date of Patent: Oct. 5, 1993

[54] MAGNETIC LOCK DEVICE

[75] Inventor: Yoshihiro Aoki, Tokyo, Japan

[73] Assignee: Application Art Laboratories Co., Ltd., Tokyo, Japan

[21] Appl. No.: 811,931

[22] Filed: Dec. 23, 1991

[30] Foreign Application Priority Data

Dec. 28, 1990 [JP] Japan ..... 2-417579

[51] Int. Cl.[5] ..... A44B 21/00

[52] U.S. Cl. ..... 24/303

[58] Field of Search ..... 292/251.5; 248/206.5; 24/303, 49 M; 335/285

[56] References Cited

U.S. PATENT DOCUMENTS 4,700,436 10/1987 Moria .
4,825,526 5/1989 Shenter et al. ..... 29/303
4,924,559 5/1990 Merchesi ..... 29/303

FOREIGN PATENT DOCUMENTS 58-170007 10/1983 Japan ..... 335/285
61-190904 8/1986 Japan ..... 335/285
2192930 1/1988 United Kingdom .

*Primary Examiner*—James R. Brittain
*Attorney, Agent, or Firm*—Wenderoth, Lind & Ponack

[57] ABSTRACT

A magnetic lock device provides a powerful magnetic attraction by making full use of the magnetic lines of force provided by a permanent magnet without causing. A first part provides a magnetic attracting action, and a second part that is magnetically attracted by the first part. The first part includes a permanent magnet, a first ferromagnetic plate rigidly attached to one side of the permanent magnet, and a nonmagnetic enclosure for packaging the permanent magnet and the first ferromagnetic plate into one unit. The second part includes a second ferromagnetic plate detachably attached to the other side of the permanent magnet and has a ferromagnetic rod extending therefrom adapted to be inserted into center bores through the permanent magnet and enclosure for engaging the first ferromagnetic plate or its ferromagnetic rod. The magnetic lock device further includes an arrangement for enhancing the magnetism at the point where the first and/or second ferromagnetic plate(s) and the ferromagnetic rod(s) are connected for increasing the cross sectional area of the magnetic path.

18 Claims, 3 Drawing Sheets

MAGNETIC LOCK DEVICE

BACKGROUND OF THE INVENTION

1. Field of the Invention

The present invention relates to a magnetic lock device that makes use of the attracting action of magnetism.

2. Description of the Prior Art

A conventional magnetic lock device comprises two parts, one of which provides magnetically attracting action and includes a permanent magnet having a center bore therethrough and having a first side for providing one polarity and a second side opposite the first side for providing the opposed polarity, a first ferromagnetic plate rigidly attached to the first side of the permanent magnet, and a nonmagnetic enclosure having a center bore aligned with the center bore of the permanent magnet for packaging the permanent magnet and enclosure into one unit, and this part may be referred to as the "magnetically attracting part". The other part is magnetically attracted by the magnetically attracting part and includes a second ferromagnetic plate to be detachably attached to the magnetically attracting part, and the other part may be referred to as the "magnetically attracted part". The first ferromagnetic plate may have a rod of ferromagnetic material extending therefrom or not, and the second ferromagnetic plate has a rod of ferromagnetic material extending therefrom which can meet the first ferromagnetic plate or its rod when the rod of the second ferromagnetic plate is inserted into the center bores through the enclosure and permanent magnet. The magnetic lock device may be used as attachments for handbags, baggage and other similar bags, or clothing, belts, and other similar articles.

The conventional magnetic lock device is constructed such that a magnetic circuit may be concluded by the permanent magnet and the first and second ferromagnetic plates when the two parts are to be coupled together. In the magnetic circuit, the magnetic lines of force from the permanent magnet may be centered onto the rods that meet each other or the rod that directly engages the corresponding ferromagnetic plate inside the bores. Thus, a powerful magnetic attraction may be provided.

The conventional magnetic lock device is based on the principle of operation in which the magnetic lines of force that emanate from one pole of the permanent magnet pass through the magnetic circuit toward the opposed pole. Specifically, those magnetic lines of force pass through the first and second ferromagnetic plates, centering onto the rod or rods through which they are directed to the point at which the rods meet or the rod directly engages the corresponding plate. This way, the magnetic flux density may be increased at that meeting point.

According to the conventional magnetic lock device, each of the first and second ferromagnetic plates is made of iron, which is usually one mm thick so as to meet reduced-size requirements. Because of its reduced thickness, the plate will tend to reach its saturation point of magnetization prematurely, above which point no more magnetic lines of force can be transmitted to its rod. Those magnetic lines of force will be lost as external magnetic leaks. A more powerful permanent magnet may be used to compensate for the loss, but the magnetic attraction cannot be increased because the magnetization is saturated prematurely.

SUMMARY OF THE INVENTION

In light of the above described problems, it is the object of the present invention to provide a magnetic lock device that can make full use of the magnetic lines of force provided by the permanent magnet so that all of the magnetic lines of force can be transmitted through the plates toward the respective rod or rods without being magnetically saturated.

In order to achieve the above object, the magnetic lock device according to the present invention comprises two parts, one part (which may be referred to as the "magntically attracting part", or simply "part A") including a permanent magnet having a center bore therethrough and having a first side for providing one polarity and a second side for providing the opposed polarity, a first ferromagnetic plate rigidly attached to the first side of the permanent magnet, and a nonmagnetic enclosure for packaging the permanent magnet and the first ferromagnetic plate into one unit. The other part (which may be referred to as the "magnetically attracted part", or simply "part B") includes a second ferromagnetic plate. The first ferromagnetic plate may or may not have a rod of ferromagnetic material extending therefrom, depending upon the particular application, and the second ferromagnetic plate has a rod of ferromagnetic material extending therefrom that can engage the first ferromagnetic plate or the rod thereof when the rod of the second ferromagnetic plate is inserted into the bores through the permanent magnet and enclosure. The present invention may be characterized by the fact that the device includes means for enhancing the magnetism for enlarging the cross section area of the magnetic path that is provided at the point where the first and/or second ferromagetic plate(s) and the rod(s) are connected. The magnetism may be enhanced by increasing the cross section through the magnetic path across the connecting point.

Specifically, this means may take several forms. One form may include an additional ferromagnetic plate that is attached to either of the first and second ferromagnetic plates. For another form, a diametrically enlarged portion may be provided on the rod of either of the first and second ferromagnetic plates so that it can engage the first or second ferromagnetic plate flatly. Still another form may include a fastening member made of ferromagnetic materials that is attached to the back of the first or second ferromagnetic plate.

The means for enhansing the magnetism provides the increased cross section through the magnetic path at the connecting point of the first or second ferromagnetic plate and ferromagnetic rod thereon, thereby avoiding the magnetic saturation that would otherwise occur when the magnetic lines of force are traveling through the magnetic path and are then centered onto the rod. Thus, all of the magnetic lines of force from the permanent magnet can be directed to the rod.

BRIEF DESCRIPTION OF THE DRAWINGS

The above and other objects, features, and advantages of the present invention may be understood from the detailed description of several preferred embodiments that follows with reference to the accompanying drawings, in which.

DETAILED DESCRIPTION OF THE PREFERRED EMBODIMENTS

Figure 1:
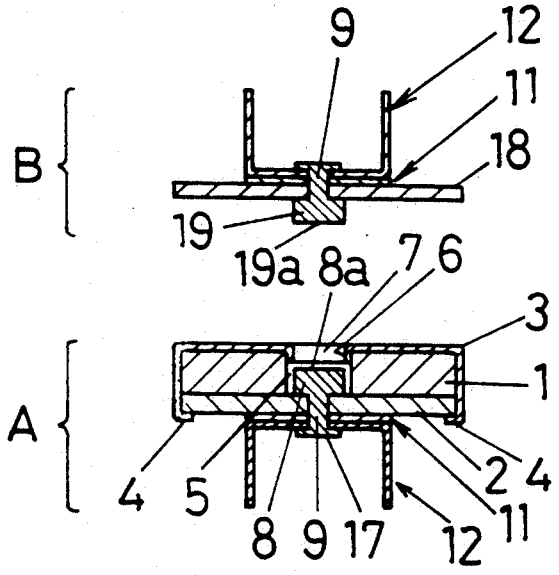
FIG. 1 illustrates a cross section of a magnetic lock device according to a first preferred embodiment.

Referring to FIG. 1, a magnetic lock device according to a first preferred embodiment comprises a part A which provides a magnetic attracting action, and a part B which is magnetically attracted by the part A. The part A includes a cylindrical permanent magnet 1 having a center bore 5 therethrough and having a first side for providing one polarity and a second side for providing the opposed polarity, a first ferromagnetic plate 2 made of iron and rigidly attached to the first side of the permanent magnet 1, and an enclosure 3 made of non-magnetic material, such as brass. The enclosure 3 is formed like a cylindrical shape closed at the top and open at the bottom. It has a center bore 7 at the top that is aligned with the bore 5 of the permanent magnet 1, and a plurality of nails 4 extending inwardly from the peripheral bottom edge. The nails 4 engage the peripheral bottom edge of the first ferromagnetic plate 2. Thus, the permanent magnet 1 and first ferromagnetic plate 2 are packaged by the enclosure 3 into one unit.

The center bore 7 on the top of enclosure 3 is formed such that it includes a downwardly extending skirt 6 that is fitted into the center bore 5 in the permanent magnet 1, and through which the bores 5 and 7 communicate with each other.

The first ferromagnetic plate 2 has a rod 8 made of iron extending upwardly from the center of the plate 2 as viewed in FIG. 1. The rod 8 has a diameter that is slightly smaller than the bore 5 in the permanent magnet 1, and has a height or depth nearly equal to half the thickness of the permanent magnet 1. The rod 8 includes a connecting shaft 9 extending downwardly therefrom as viewed in FIG. 1. This connecting shaft 9 extends through a center bore 10 formed in the first ferromagnetic plate 2. The first ferromagnetic plate 2 is backed by an additional plate 11 of any ferromagnetic material. The additional plate 11 and a fastening member 12 to be described later are affixed to the plate 2 by means of the bottom end of the connecting shaft 9.

The additional plate 11 is made of iron, is shaped like a disc having a diameter and thickness which are substantially equal to half those of the first ferromagnetic plate 2, respectively, and has a center bore 13 into which the connecting shaft 9 passes. The fastening member 12 includes a base 15 and a pair of legs 14 extending downwardly from the base. The base 15 has a center bore 16 into which the connecting shaft 9 passer. The connecting shaft 9 passes through the first ferromagnetic plate 2 and then through the additional plate 11 and the fastening member 12. The bottom end of the connecting shaft 9 that is exposed from the fastening member 12 is pressed like a rivet at 17, which couples all the parts together.

The part B includes a second ferromagnetic plate 18 made of iron which is magnetically attracted toward the second side of the permanent magnet 1 when the part B is brought close to the enclosure 3. The second ferromagnetic plate 18 is formed in a disc shape, and has an iron rod 19 extending downwardly therefrom as viewed in FIG. 1. The plate 18 is backed by an additional ferromagnetic plate 11. The rod 19 has a diameter that is slightly smaller than the diameter of the skirt 6, and has a height or depth sufficient to permit the rod to reach or abut against the first ferromagnetic plate 2 or its rod 8 when the second ferromagnetic plate 18 is placed on the enclosure 3. Like the rod 8 for the first ferromagnetic plate 2, the rod 19 has a connecting shaft 9 which is inserted through the second ferromagnetic plate 18, the additional ferromagetic plate 11, and a fastening member 12, all of which are coupled together by pressing the bottom end of the shaft 9 like a rivet.

Figure 3:
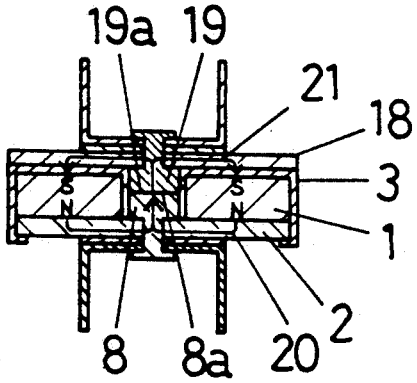
FIG. 3 illustrates a cross section of the device in FIG. 1, with the two parts A and B coupled together.

In the embodiment of the magnetic lock device described above, when the part A and the part B are coupled together as shown in FIG. 3, the second ferromagnetic plate 18 engages the top surface of the enclosure 3, with the rod 19 on the plate 18, through the bores 5 and 7, engaging the rod 8 on the first ferromagnetic plate 2 at respective ends 19*a* and 8*a* thereof.

As coupled together as shown in FIG. 3, a magnetic circuit is created in which the magnetic lines of force emanate from the first side of the permanent magnet 1 (assuming that the first side provides the N pole), traveling through the first ferromagentic plate 2 and then centering onto the rods 8 and 19 meeting together, from which they go through the second ferromagnetic plate 18 as they are radiating radially. Finally, they return to the second side of the permanent magnet 1 that provides the S pole. It may be understood that when the magnetic lines of force are passing from the first ferromagnetic plate 2 to the second ferromagnetic plate 18, they are centered onto the respective rods 8 and 19 between the plates 2 and 18 so that the magnetic flux density is increasing gradually from the respective peripheral marginal edges toward the respective centers of the plates.

It may be possible that the magnetic flux density will reach its saturation point about the respective center areas of the first and second ferromagnetic plates 2 and 18, but those respective magnetic lines of force which exceed the saturation point can be directed through the additional plate 11 to the rod 8, and through the rod 19 to the additional plate 11.

Thus, all of the magnetic lines of force from the permanent magnet 1 can be directed to the respective ends 8*a* and 19*a* of the rods 8 and 19 without causing any external magnetic leaks, thereby providing a poweful magnetic attracting action.

Figure 9:
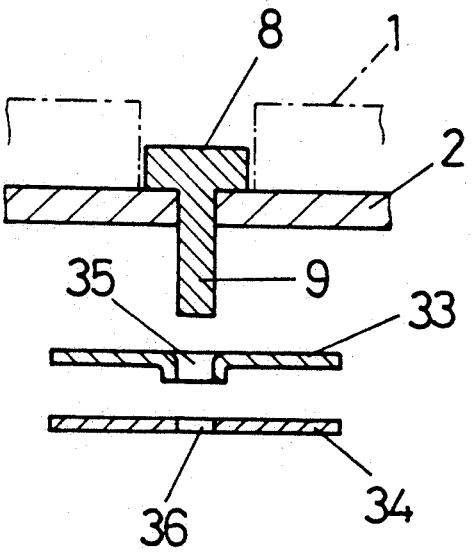
FIG. 9(*a*) illustrates an exploded cross section of a magnetic lock device according to a seventh preferred embodiment, and FIG. 9(*b*) illustrates the cross section of the same device assembled together.
Figure 9:
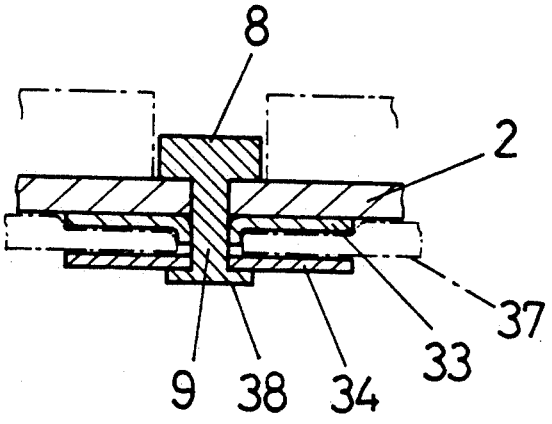

In the embodiment decribed above, the bore 13 of the additional plate 11 for each of the first and second ferromagnetic plates 2 and 18 may be formed so that it includes a skirt portion (as shown in FIG. 9).

Figure 4:
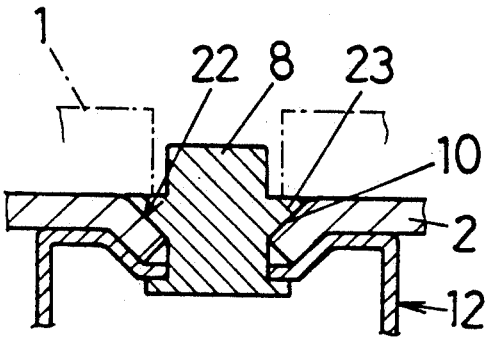
FIG. 4 illustrates a cross section of a magnetic lock device according to a second preferred embodiment, with some portions shown on an enlarged scale.

A variation of the means for enhancing the magnetism is shown in FIG. 4. As seen from FIG. 4, a center bore 10 is provided on the first ferromagnetic plate 2 by means of a press. The center bore 10 is formed to include an expanded portion 22 like a funnel, and the rod 8 is also formed to include an expanded portion 23 that conforms to the expanded portion 22.

Figure 5:
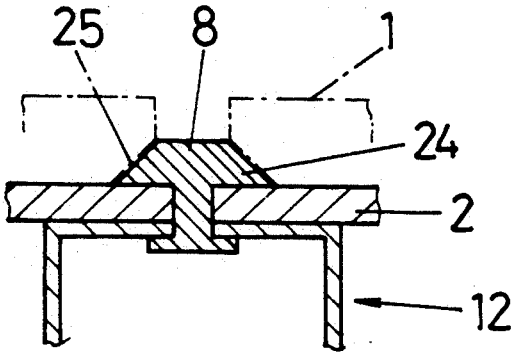
FIG. 5 illustrates a cross section of a magnetic lock device according to a third preferred embodiment, with some portions shown on an enlarged scale.

Another variation of the means for enhancing the magnetism may be provided as shown in FIG. 5. In this variation, the first ferromagnetic plate 2 has a rod 8 formed like a trapezoidal shape 24 in cross section, and the permanent magnet 1 has a center bore 5 that includes a tapered portion 25 that conforms to the portion of the trapezoidal shape 24 of the rod 8 for accepting it.

Figure 6:
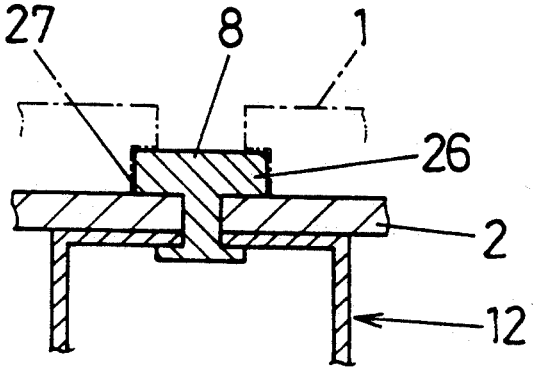
FIG. 6 illustrates a cross section of a magnetic device according to a fourth preferred embodiment, with some portions shown on an enlarged scale.

Another variation of the means for enhancing the magnetism may be provided as shown in FIG. 6. In this variation, the first ferromagnetic plate 2 has a rod 8 having a diametrically enlarged portion 26, and the permanent magnet 1 has a center bore 5 including a corresponding diametrically enlarged portion 27 that conforms to the shape of the rod 8 for accepting the rod 8.

In each of the above variations, each respective diametrically enlarged portion 23, 24, or 26 engages each corresponding first ferromagnetic plate 2 at respective meeting ends, so that the magnetic lines of force can travel from the respective first ferromagnetic plate 2 and through the respective meeting ends to the respective the ferromagnetic rod 8 without being magnetically saturated. For any of the those variations, the means for enhancing the magnetism as described with reference to the variations may also be provided between the second ferromagnetic plate 18 and the rod 19.

Figure 7:
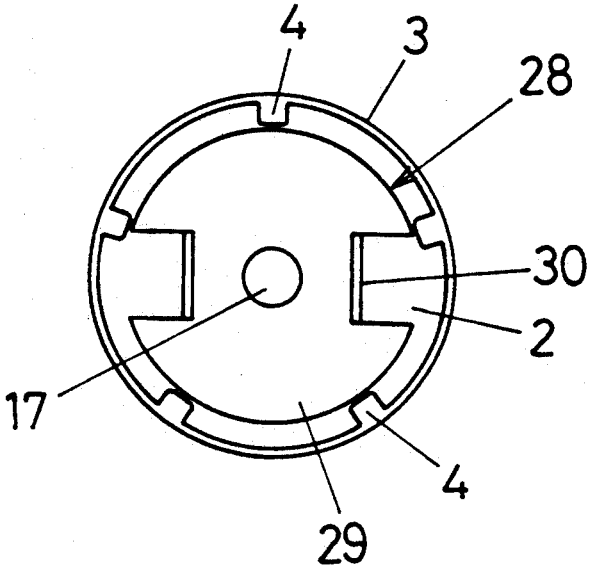
FIG. 7(*a*) illustrates a bottom view of a magnetic lock device according to a fifth preferred embodiment, and FIG. 7(*b*) illustrates a cross section of the same device, with some portions shown on an enlarged scale.
Figure 7:
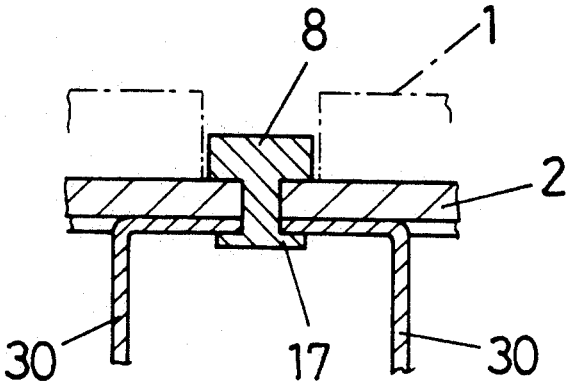

FIG. 7 shows a variation of the means for enhancing the magnetism that is provided in the form of a fastening member. As seen from FIGS. 7(*a*) and (*b*), a fastening member 28 includes a disc plate 29 made of iron having a center bore whose diameter is smaller than that of the first ferromagnetic plate 2 and a pair of legs 30 formed from the disc plate 29 such that they extends like a U shape in cross section as viewed in FIG. 7(*b*). The disc plate 29 is rigidly attached to the first ferromagnetic plate 2 by means of the connecting shaft 9 of the rod 8.

According to the variation shown in FIGS. 7(*a*) and (*b*), the magnetic lines of force travel from the peripheral edge area toward the center area of the first ferromagnetic plate 2. The remaining part of the magnetic lines of force that have been saturated at the center area can be directed to the rod 8 through the disc plate 29. Thus, the magnetic flux density can be increased before the saturation point is reached. This concept may also be implemented on the part B. It should be understood that an additional disc plate of iron may be provided between the plate 2 and disc plate 29, thereby increasing the cross section through the magnetic path.

Figure 8:
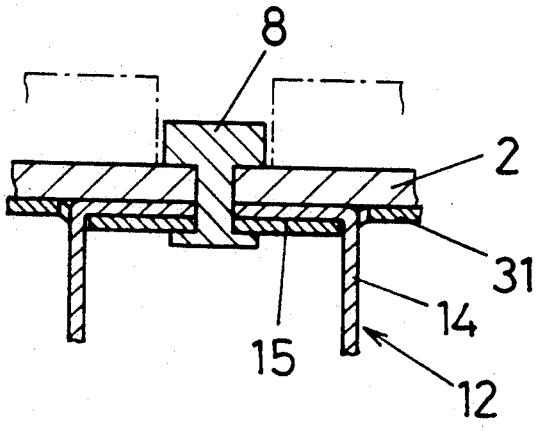
FIG. 8(*a*) illustrates a cross section of a magnetic lock device according to a sixth preferred embodiment, with some portions shown on an enlarged scale, and FIG. 8(*b*) illustrates a bottom view of the same device.
Figure 8:
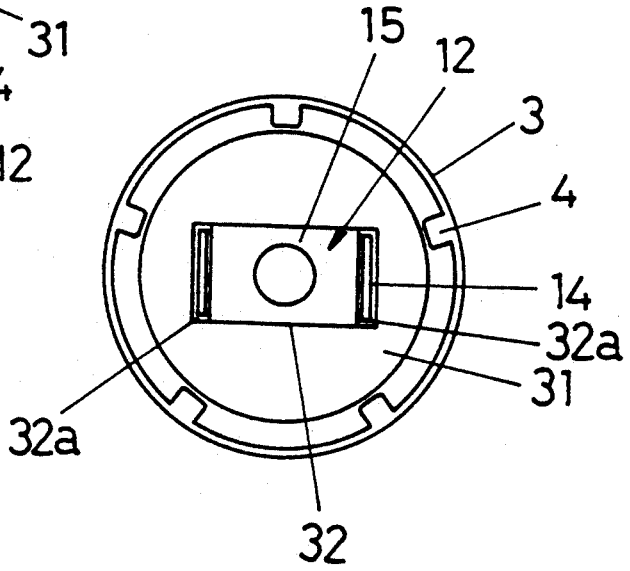

Referring to FIG. 8, there is another preferred embodiment in which the fastening member 12 is backed by an additional disc plate 31 that provides the means for enhancing the magnetism. The additional plate 31 is made of iron, and has a diameter which is slightly smaller than that of the first ferromagnetic plate 2. It includes a rectangular recess 32 at the center that accepts tha base 15 of the fastening member 12 attached to the back of the first ferromagnetic plate 2. The rectangular recess 32 has openings 32*a* on the lateral sides thereof through which the pair of legs 14 can be inserted.

Figure 2:
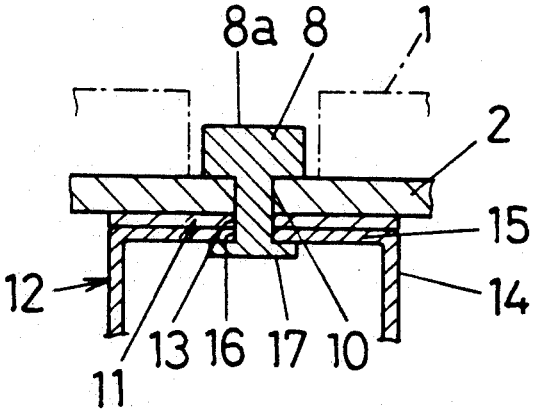
FIG. 2 illustrates a cross section of the device in FIG. 1, with some portions shown on an enlarged scale.

The means for enhancing the magnetism described with reference to FIGS. 1, 2, and 3 for the part A or B or both is not limited to those embodiments where its constituent parts are previously assembled as described, but may be varied as shown in FIG. 9. As seen from FIG. 9(*a*), it may include the rod 8, an additional plate 33, and a backing washer 34 which are separately provided and may be mounted to the first ferromagnetic plate 2 in the sequence given above. In this case, the rod 8 has the connecting shaft 9 longer than those in the preceding embodiments. The additional plate 33 is made of iron, is formed like a disc, as in the preceding embodiments, and has a center bore 35 formed from a barring. The back washer 34 has a disc form like the additional plate 33, and has a center bore 36 therethrough. The back washer 34 may be made of nonmagnetic or ferromagnetic materials.

According to the embodiments described above, the additional plates 31 and 33 may be mounted to the back of the first ferromagnetic plate 2 when the device is actually used on an article such as a handbag. This fastening process is explained by referring to FIG. 8. For example, when the part A is fastened to the article, the pair of legs 14 of the fastening member 12 are pierced into the article, and then folded over behind the article, thereby coupling the additional plate 31 and first ferromagnetic plate 2 together. This process may apply to the part B.

For the embodiment shown in FIG. 9, the fastening process may be accomplished in a similar manner. With the connecting shaft 9 of the rod 8 being mounted to the center bore 35 of the additional plate 33 as shown in FIG. 9(*b*), the connecting shaft 9 is inserted through the article 37, and then the back washer 34 is mounted to the portion of the connecting shaft 9 that is exposed behind the article 37. Then, the bottom end of the connecting shaft 9 is pressed to provide a rivet 38. This rivet 38 secures the part A to the article 37, with the first ferromagnetic plate 2 and the additional plate 33 coupled together.

It may be appreciated from the various preferred embodiments and the respective variations thereof that the means for enhancing the magnetism allows the magnetic lines of force to pass through the magnetic circuit without being saturated. As such, the magnetic force provided by the permanent magnet can be fully utilized without causing any external magnetic leaks. Thus, a poweful magnetic attraction can be provided.

although the present invention has been described in full detail with reference to the embodiments, it should be understood that various changes and modifications may be made without departing from the spirit and scope of the invention as defined in the appended claims.

What is claimed is:

1. A magnetic lock device, comprising:

a first element, comprising a permanent magnet having a center bore traversing said permanent magnet, said permanent magnet having a first side for providing one polarity and a second side opposite to said first side for providing the opposite polarity, a first ferromagnetic plate rigidly attached to said first side of said permanent magnet, and a non-ferromagnetic enclosure enclosure the permanent magnet and said first ferromagnetic plate, said non-ferromagnetic enclosure having a center bore aligned with said center bore of said permanent magnet;

a second element, comprising a second ferromagnetic plate, for detachable engagement with said first element;

a rod of ferromagnetic material extending from said second ferromagnetic plate for magnetically disengageably engaging said first ferromagnetic plate in said center bore of said permanent magnet; and means for enhancing the magnetism provided by said permanent magnet at the point where said rod of ferromagnetic material engages with said first ferromagnetic plate in said center bore by increasing the cross-sectional area of a magnetic path, said means comprising an additional ferromagnetic plate attached to one of said first and said second ferromagnetic plates; and attachment means for attaching said first and second elements to articles to be locked together.

2. The magnetic lock device of claim 1, wherein said additional ferromagnetic plate is attached to said first ferromagnetic plate on a side thereof opposite to said permanent magnet, said additional ferromagnetic plate having a smaller diameter than said first ferromagnetic plate.

3. The magnetic lock device of claim 2, wherein said attachment means comprises a fastening member on said first element mounted such that said additional ferromagnetic plate is sandwiched between said first ferromagnetic plate and said fastening member.

4. The magnetic lock device of claim 3, wherein said first ferromagnetic plate has another rod of ferromagnetic material extending therefrom in said center bore of said permanent magnet for magnetically disengageably engaging the first said rod, said another rod having a connecting shaft extending through said first ferromagnetic plate and connecting said additional ferromagnetic plate and said fastening member to said first ferromagnetic plate.

5. The magnetic lock device of claim 4, wherein said fastening member has a base lying against said additional ferromagnetic plate and a pair of legs extending from said base.

6. The magnetic lock device of claim 4, wherein said fastening member is a back washer spaced from said additional ferromagnetic plate for receiving an article to which said first element is to be attached therebetween.

7. The magnetic lock device of claim 1, wherein said additional ferromagnetic plate has a smaller diameter than either said first or second ferromagnetic plate, and wherein said attachment means includes a fastening member mounted such that said additional ferromagnetic plate is sandwiched between said fastening member and said one of said first and second ferromagnetic plates.

8. The magnetic lock device of claim 7, wherein said fastening member has a base lying against said additional ferromagnetic plate and a pair of legs extending from said base.

9. The magnetic lock device of claim 7, wherein said fastening member is a back washer spaced from said additional ferromagnetic plate for receiving an article therebetween.

10. The magnetic lock device of claim 7, wherein both said first and second ferromagnetic plates have a respective said additional ferromagnetic plate and a respective said fastening member mounted such that said additional ferromagnetic plates are sandwiched between the respective said fastening member and the respective said first or second ferromagnetic plate.

11. The magnetic lock device of claim 10, wherein said first ferromagnetic plate has another rod of ferromagnetic material extending therefrom in said center bore of said permanent magnet for magnetically disengageably engaging the first said rod, both said rods having a connecting shaft extending through their respective said first or second ferromagnetic plate connecting the respective said additional ferromagnetic plate and the respective said fastening member thereto.

12. The magnetic lock device of claim 1, wherein said additional ferromagnetic plate has an outer circumference with a diameter smaller than the diameter of said one of said first and said second ferromagnetic plates, and wherein said attachment means comprises legs extending from said additional ferromagnetic plate away from said one of said first and second ferromagnetic plates at a position on said additional ferromagnetic plate closer to the center of said additional ferromagnetic plate than said outer circumference thereof.

13. The magnetic lock device of claim 12, wherein said legs are unitary and one-piece with said additional ferromagnetic plate.

14. The magnetic lock device of claim 1, wherein said attachment means comprises a fastening member having a base between said additional ferromagnetic plate and said one of said first and second ferromagnetic plates.

15. The magnetic lock device of claim 14, wherein said additional ferromagnetic plate has a central recess receiving said base and a pair of openings through which extend legs from said base.

16. The magnetic lock device of claim 1, wherein both said first and second ferromagnetic plates have a respective said additional ferromagnetic plate thereon.

17. The magnetic lock device of claim 16, wherein said first ferromagnetic plate has another rod of ferromagnetic material extending therefrom in said center bore of said permanent magnet for magnetically disengageably engaging the first said rod, both said rods having a connecting shaft extending through the respective said first or second ferromagnetic plate and connecting the respective said additional ferromagnetic plates thereto.

18. The magnetic lock device of claim 17, wherein said attachment means comprises a fastening member connected to each respective said element by the respective said connecting shaft.

* * * * *